US007004056B2

(12) United States Patent
Shorter et al.

(10) Patent No.: US 7,004,056 B2
(45) Date of Patent: Feb. 28, 2006

(54) CUTTING MACHINE

(76) Inventors: Carolyn Shorter, 25 Clinton Ave., Ellenville, NY (US) 12428; James Shorter, 25 Clinton Ave., Ellenville, NY (US) 12428

( * ) Notice: Subject to any disclaimer, the term of this patent is extended or adjusted under 35 U.S.C. 154(b) by 26 days.

(21) Appl. No.: 10/876,090

(22) Filed: Jun. 24, 2004

(65) Prior Publication Data

US 2005/0284273 A1 Dec. 29, 2005

(51) Int. Cl.
*B26D 5/16* (2006.01)

(52) U.S. Cl. ..... 83/603; 83/156; 83/350; 83/673; 83/932; 99/537; 99/538; 99/584; 425/289; 425/374; 426/478

(58) Field of Classification Search ..... 83/706, 83/707, 156, 215, 266, 350, 351, 353, 673, 83/865, 596, 932, 221, 222, 225, 729, 564, 83/602, 603; 99/537–541, 584–591, 623, 99/450.1, 353–355; 426/502–503, 389, 478; 425/363, 364 R, 374, 289, 315
See application file for complete search history.

(56) References Cited

U.S. PATENT DOCUMENTS

| | | | | |
|---|---|---|---|---|
| 3,738,212 | A * | 6/1973 | Goodale | 83/602 |
| D250,568 | S | 12/1978 | Belinkoff | |
| D256,318 | S | 8/1980 | Levin | |
| D282,620 | S | 2/1986 | Cavalli | |
| D292,364 | S | 10/1987 | Bartlett | |
| D316,207 | S | 4/1991 | Gaber | |
| D324,322 | S | 3/1992 | Barrault | |
| D345,079 | S | 3/1994 | Johnson | |
| D373,049 | S | 8/1996 | la Rouzic | |
| D395,194 | S | 6/1998 | Wong | |
| 6,125,741 | A | 10/2000 | Shorter et al. | |

* cited by examiner

*Primary Examiner*—Allan N. Shoap
*Assistant Examiner*—Phong Nguyen

(57) ABSTRACT

A Cutting Machine for processing leafy vegetables such as collard greens is provided. The Cutting Machine is adjustable to accommodate vegetables of varying thicknesses. An enclosure with a cover has an input opening in the cover to feed material to be cut between the rollers. An actuating shaft which is rotated includes an offset wheel and an offset shaft. An actuating rod on the offset wheel swings a pivoting knife back and forth to cut the material. An actuating shaft which is connected to the offset shaft moves a roller cog mounted on the drive roller.

16 Claims, 6 Drawing Sheets

CUTTING MACHINE

BACKGROUND OF THE INVENTION

1. Field of the Invention

This invention relates to food processing devices, and more specifically to a device for cutting a leafy vegetable such as collard greens or spinach.

2. Prior Art and Objects

The problem of cutting certain food products, primarily collard greens, has previously been recognized. The Shorter Patent, U.S. Pat. No. 6,125,741, issued Oct. 3, 2000, describes a device primarily for cutting collard greens. That device provides for shredding the vegetable vertically through two rollers and also for cutting the vegetable longitudinally. One roller, the back roller, has circumferential grooves, while the other roller, the front roller, has cutting wheels which ride in the grooves. Longitudinal cutting is achieved by a knife activated by cams mounted on the front roller. The knife strikes against the grooved roller and is powered for the cutting action by a spring. The striking of the knife is critical and, if not accurately set, will either not cut or will damage the back roller.

It has also been found that adequate cutting can be achieved by making only the horizontal cut. Since various vegetables with varying thicknesses need to be processed in the Cutting Machine, it has also been recognized that there is a definite need to make the Cutting Machine adjustable for different vegetables.

Therefore, one object of the present invention is to provide an improved Cutting Machine for processing leafy vegetables such as collard greens.

A second object of the present invention is to provide a Cutting Machine that is adjustable to accommodate vegetables of varying thicknesses.

A third object of the present invention is to provide a Cutting Machine that is dependable and economical.

A fourth object of the present invention is to provide a Cutting Machine that is safe and easy to use anywhere.

SUMMARY OF THE INVENTION

A cutting machine for cutting food products such as collard greens is provided. The cutting Machine is generally located within an enclosure. The enclosure has an input opening through with material to be cut is inserted. A frame is located within the enclosure. A drive roller is mounted to rotate within the enclosure. A roller cog is affixed to the drive roller. A tensioning roller mounted in the enclosure adjacent to and generally aligned with the drive roller. A pair of tensioning shafts extend from outside the enclosure into the enclosure. An actuating shaft extends within the enclosure. The actuating shaft is rotatable and includes an offset wheel and an offset shaft. A Means for is also included for rotating the actuating shaft. A stationary blade is mounted on the frame generally beneath the drive roller. A knife is mounted to pivot on the frame so as to interact with the stationary blade. An actuating rod is mounted to pivot on the knife and on the offset wheel. A cog driver is connected to the offset shaft to engage the roller cog and means for rotating the actuating shaft is provided.

DESCRIPTION OF THE NUMERALS

Numeral Description
21 Enclosure
25 Legs
27 Front Wall
29 Rear Wall
31 Two Side Walls
33 Cover
35 Input Opening
37 Guide Flaps
39 Tensioning Shafts
40 Left Tensioning Shaft
41 Right Tensioning Shaft
42 Two Knobs
43 Hinge
45 Drive Roller
47 Tensioning Roller
48 Tensioning Roller Shaft
49 Tensioning Roller Body
50 Adjuster Springs
51 Drive Roller Shaft
52 Drive Roller Body
53 Roller Cog
55 Journal Blocks
56 Threaded Section
57 Back Plate
58 Threaded Opening
59 Collar
60 Offset Wheel
61 Actuating Shaft
63 Actuating Rod
65 Knife
67 Hand Crank
68 Offset Shaft
69 Knife Pivot
70 Pivot End
71 Tip End
72 Knife Body
73 Sharp Edge
74 Dull Edge
79 Opening
81 Guide
83 Guide Mount
85 Guide Spring
92 Cog Driver

93 Cog End
94 Shaft End
95 Frame
97 Stationary Blade
98 Lower Surface
99 Upper Surface
101 Block
102 Bolt
105 Knife Edge
107 Knife Body
113 Knife Tensioning Spring
115 Knife Tensioning Collar

DETAILED DESCRIPTION OF THE PREFERRED EMBODIMENT

Figure 1:
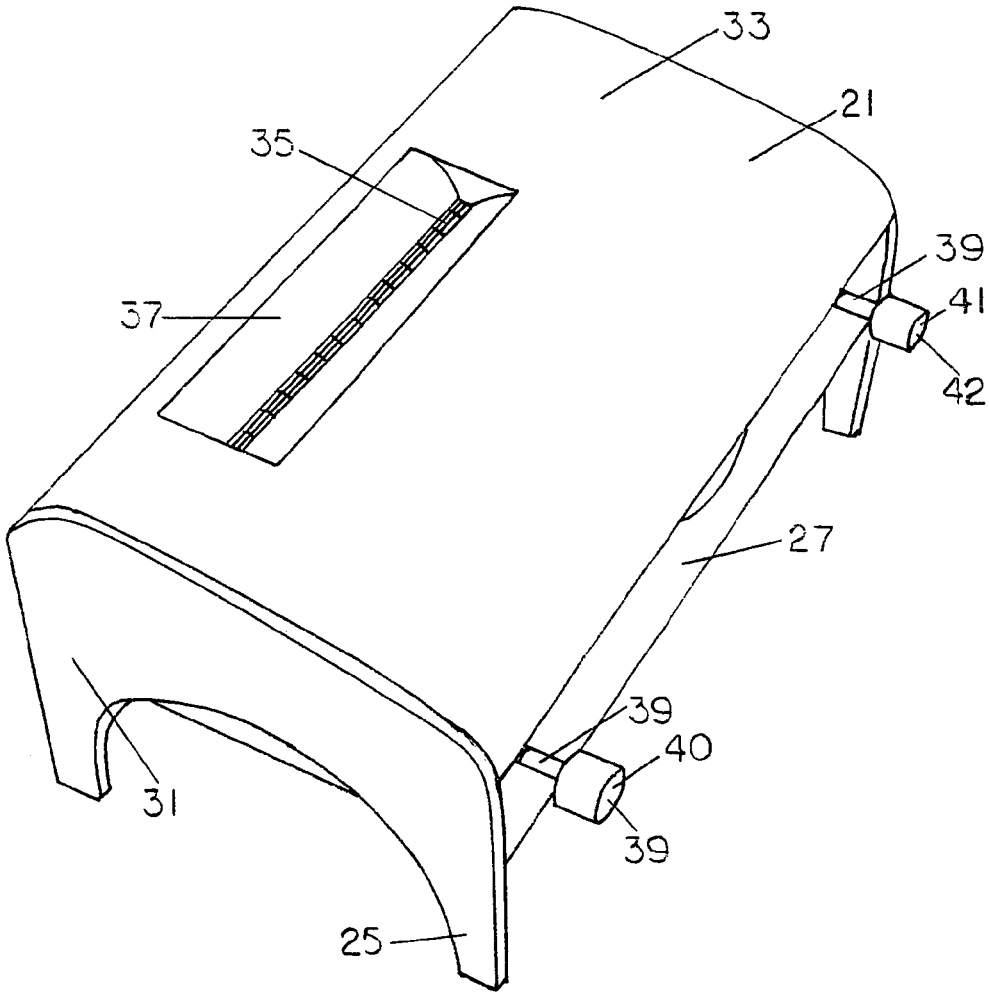
FIG. 1 is a pictorial view of the Cutting Machine with the cover closed.

Referring now to FIG. 1, the Cutting Machine is shown encased within an enclosure 21. The enclosure 21 has legs 25 to raise the Cutting Machine off of a surface where it is placed such as a kitchen counter. The enclosure 21 has a front wall 27, a rear wall 29, two side walls 31, which include the legs 25, and a cover 33. The cover 33 has an input opening 35, surrounded by guide flaps 37, which are semi-rigid, for feeding vegetables or other food products into the Cutting Machine for processing. Two tensioning shafts 39, namely a left tensioning shaft 40 and a right tensioning shaft 41 extend through the front wall 27 generally parallel to the side walls 31 and generally parallel to the side walls 31 and generally adjacent the side walls 31. The tensioning shafts 39 are partially supported by the front wall 27. Two knobs 42 are shown on the ends of the two tensioning shafts 39 just outside of the front wall 27. The two tensioning shafts 39 are used for adjusting the Cutting Machine to the thickness of the food products being fed into the input opening 35 which food products the Cutting Machine is to slice into strips suitable for cooking and consumption.

Figure 2:
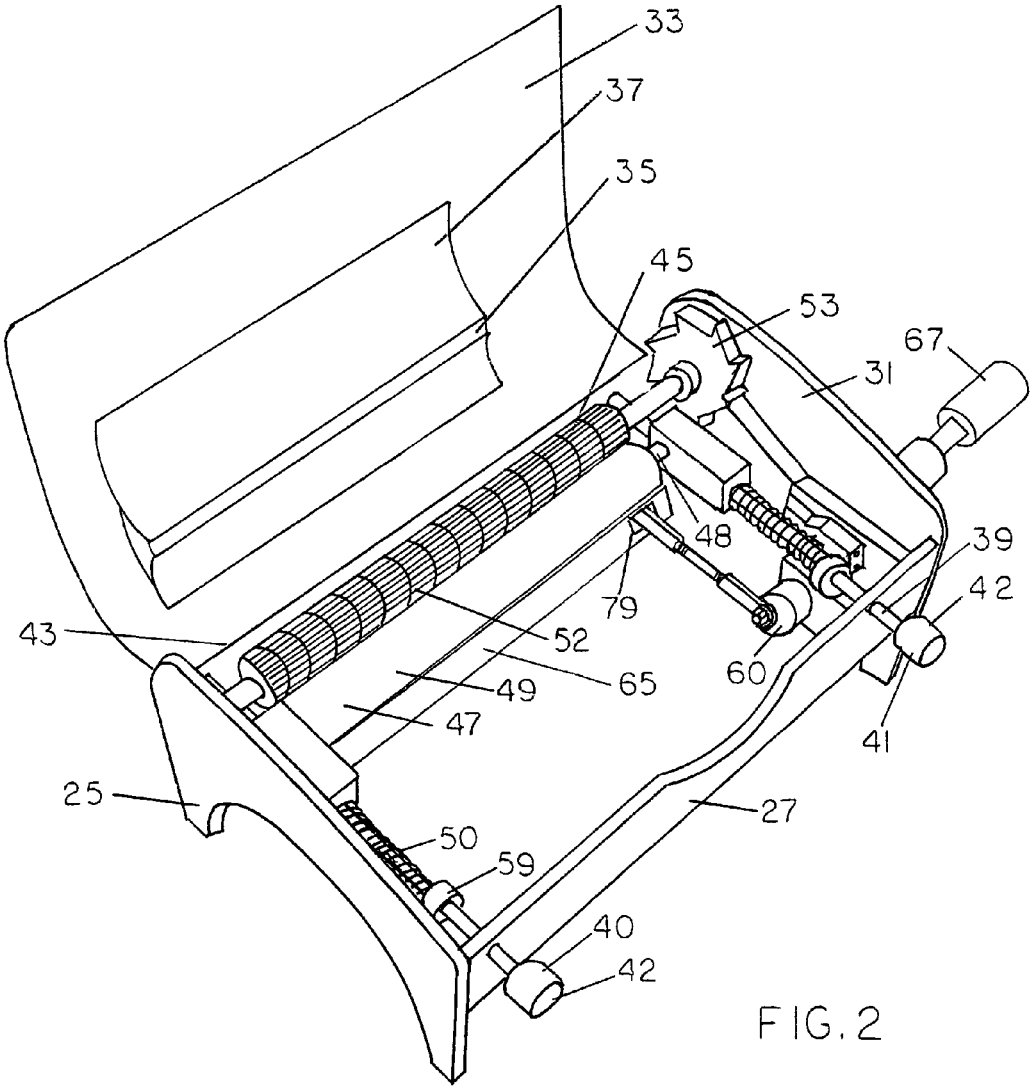
FIG. 2 is a pictorial view similar to FIG. 1, but with the cover open, showing the drive roller and the tensioning roller with the cutting blade beneath the tensioning roller.

Referring now to FIG. 2, the cover 33 of the Cutting Machine is opened by rotating on a hinge 43 which is longitudinally attached between the cover 33 and the rear wall 29 of the Cutting Machine. The one hinge 43 could be replaced by two or more shorter hinges. Inside the Cutting Machine, a drive roller 45 is located adjacent the rear wall 29 and generally parallel to the rear wall 29. A tensioning roller 47 is located immediately forward of the drive roller 45 and generally parallel to the drive roller 45. The tensioning roller 47 is mooned on a tensioning roller shaft 48. The drive roller 45 and the tensioning roller 47 are generally in close physical contact along their longitudinal axes, which enables the drive roller 45 and the tensioning roller 47 to drive downwardly any material placed between them when the drive roller is rotated. The tensioning roller 47 includes a tensioning roller shaft 48 and a tensioning roller body 49. The tensioning roller body 49 is compressible. The firmness with which the drive roller 45 and the tensioning roller 47 contact one another is controlled by two adjuster springs 50 which surround the two tensioning shafts 39. The tightness of the two adjuster springs 50 is controlled by the knobs 42 located outside the front wall 27.

The drive roller 45 is mounted on a drive roller shaft 51. The drive roller 45 includes the drive roller shaft 51 and a drive roller body 52. The drive roller body 52 is pronged. At one end of the drive roller shaft 51, the right end, facing the front wall 27, there is a roller cog 53 which is used to rotate the drive roller 45. This roller cog 53 is used to drive the driver roller 45. The drive roller 45 is mounted to rotate in the side walls 31.

Figure 8:
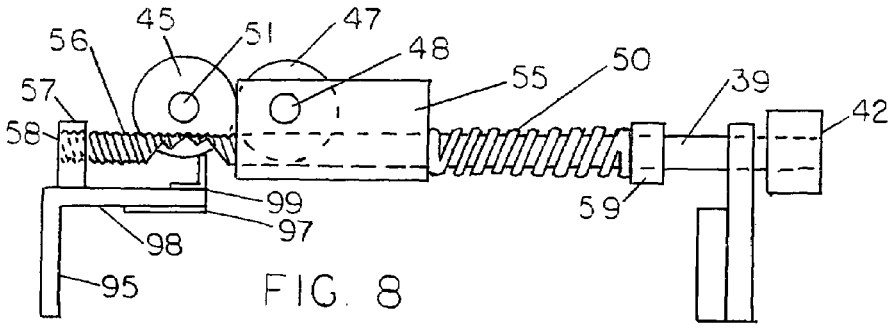
FIG. 8 is a side view of either the right or left tensioning shaft for adjusting the tension between the drive roller and the tensioning roller.

A pair of journal blocks 55 are affixed to the tensioning shafts 39, one journal block 55 on each tensioning shaft 39. The journal blocks 55 hold the two ends of the tensioning roller shaft 48. The tensioning roller 47 rotates in the journal blocks 55. Each journal block 55 is held in place with the pair of adjuster springs 50. As best seen in FIG. 8, the end of each adjuster shaft 39, remote from its respective knob 42, has a threaded section 56. A back plate 57 is located adjacent the rear wall 29. The back plate 29 has through it a threaded opening 58. The treaded section 56 engages the threaded opening 58. When the knobs 42 are turned, depending upon the direction of rotation, the respective tensioning shaft 39 moves the journal blocks 55, and thus also the tensioning roller 47 either closer to or further from the drive roller 45. A collar 59 is located on each tensioning shaft 39. Each of the two adjuster springs 50 is located between the journal blocks 55 and the collar 59. As food product is fed between the drive roller 45 the tensioning roller 47, the drive roller 45 and the tensioning roller 47 separate to accommodate the food product against the force of the spring 50.

An offset wheel 60 is affixed in an eccentric position to an actuating shaft 61 at the interior end of the actuating shaft 61. When the actuating shaft 61 is turned, the offset wheel 60 pushes and pulls an actuating rod 63 which has two ends, one end being mounted on the offset wheel 60 and the opposite end being mounted on a knife 65 such that the knife 65 is pulled and pushed in and out generally horizontally as the off-set wheel 60 rotates. The actuating shaft 61 is connected to a hand crank 67 mounted on the exterior end of the actuating shaft 61. The hand crank 67 is located on the right side of the Cutting Machine and outside the side wall 31. The hand crank 67 may be readily replaced by an electric motor (not shown). An offset shaft 68 is also located on the actuating shaft 61 inside the enclosure 21 toward the side wall 31 where the hand crank 67 is located. By rotating the actuating shaft 61, the Cutting Machine is activated by rotating both the drive roller 45 and moving the knife 65 back and forth.

Figure 3:
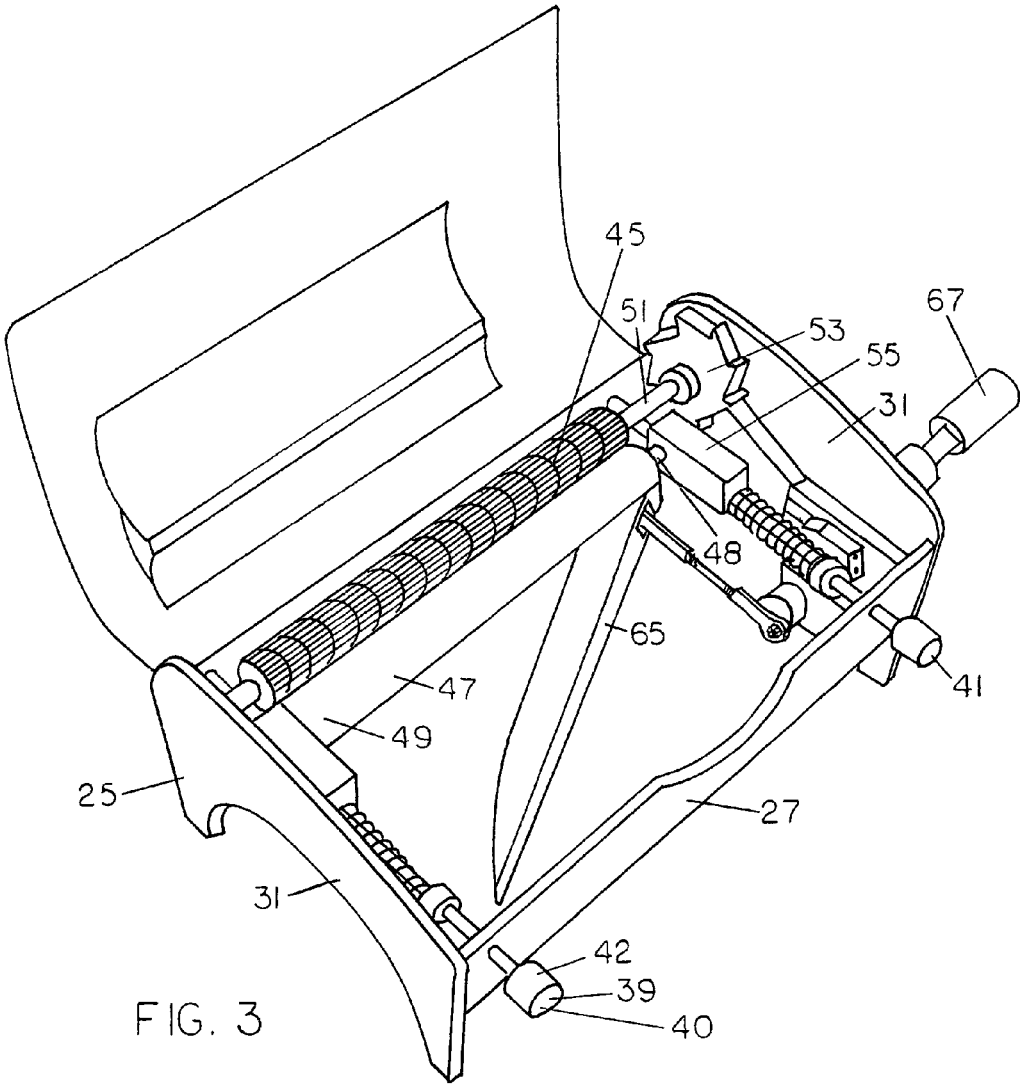
FIG. 3 is a pictorial view similar to FIG. 2, but with the knife withdrawn from beneath the tensioning roller.
Figure 6:
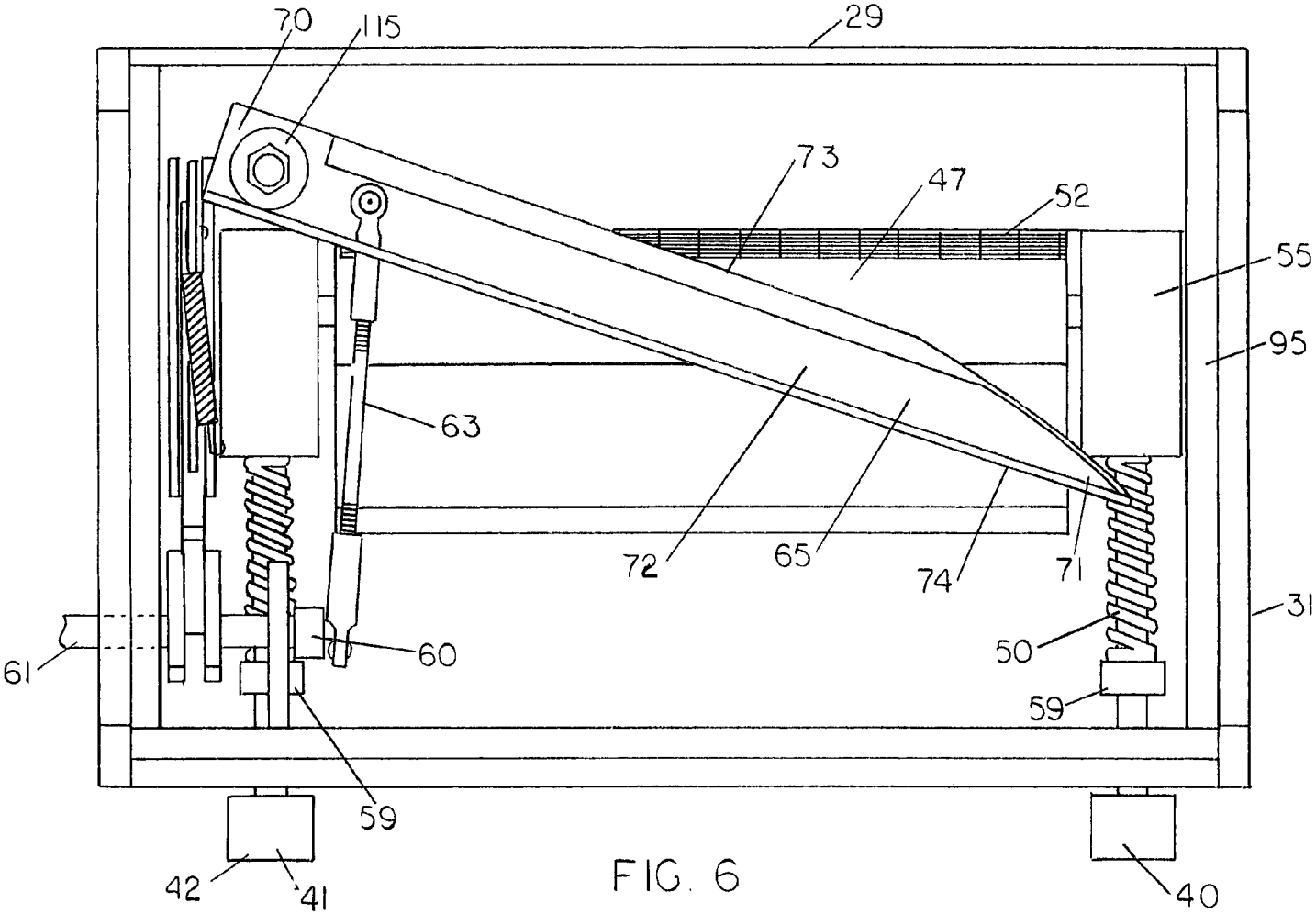
FIG. 6 is a plan view of the Cutting Machine looking up into the Cutting machine.
Figure 9:
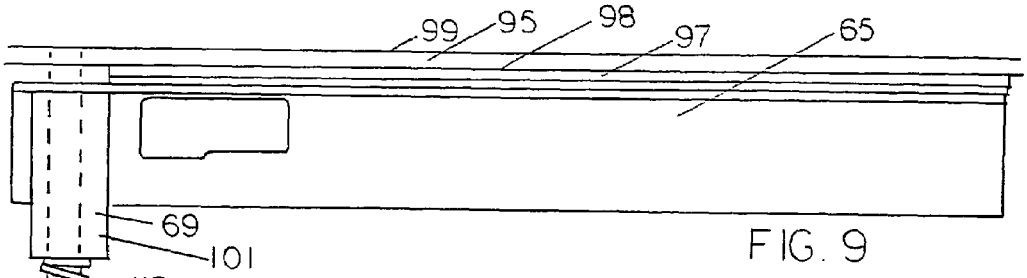
FIG. 9 is a frontal view of the knife blade and pivot joint mechanism.

Referring now to FIG. 3, the knife 65, which is located within the enclosure 21, is pivotally mounted on a knife pivot 69. When engaged, the knife 65 slides generally underneath the drive roller 45 in a generally horizontal pivoting motion. As previously explained, this generally horizontal action is driven by the actuating rod 63 attached to an offset wheel 60. As also seen in FIG. 6 and FIG. 9, a close-up view is shown of the knife mechanism of FIG. 2 and FIG. 3. In FIG. 3, the knife 65 is shown in the extended position. The knife 65 has two ends namely pivot end 70 and a tip end 71. The knife 65 includes a knife body 72 with a sharp edge 73 and a dull edge 74. An opening 79 in the knife 65 permits the actuating rod 63 to be to be secured to pivot the knife 65, thus providing a means to move the knife 65. The actuating rod 63 is connected to the knife 65 comparatively close to the knife pivot 69.

Figure 4:
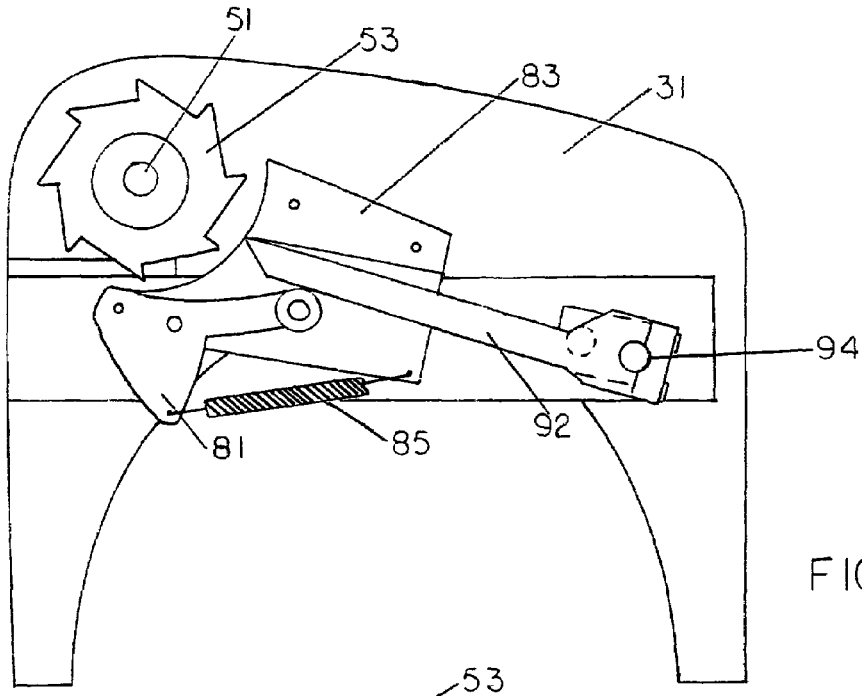
FIG. 4 is a cross-sectional side elevation of the cog and cog driver for turning the drive roller with the cog driver withdrawn from the cog.
Figure 5:
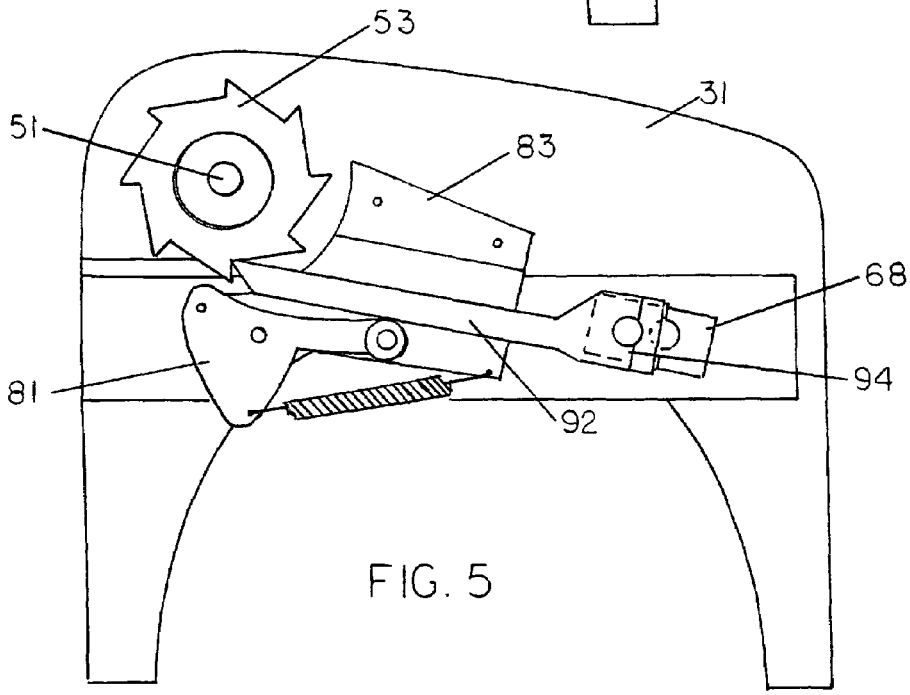
FIG. 5 is a cross-sectional side view similar to FIG. 4, but with the roller cog driver engaged in the roller cog.

Referring now to FIG. 4 and FIG. 5, the roller cog 53 is shown in two cross-sectional views. The drive roller shaft 51, which supports the drive roller 45, has the roller cog 53 mounted on it. The roller cog 53 is securely affixed to the drive roller shaft 51 so that the roller cog 53 does not move in relation to the drive roller shaft 51. The roller cog 53 is located within the enclosure 21 generally adjacent to the side wall 31, on the right side of the Cutting Machine, as faced, which is the same side of the Cutting machine where the hand crank 67 or other rotational power source is located. A guide 81 is mounted to pivot on a guide mount 83. A guide spring 85 extends between the guide 81 and the guide mount 83. The guide 81 serves as a friction-reducing mechanism.

Figure 7:
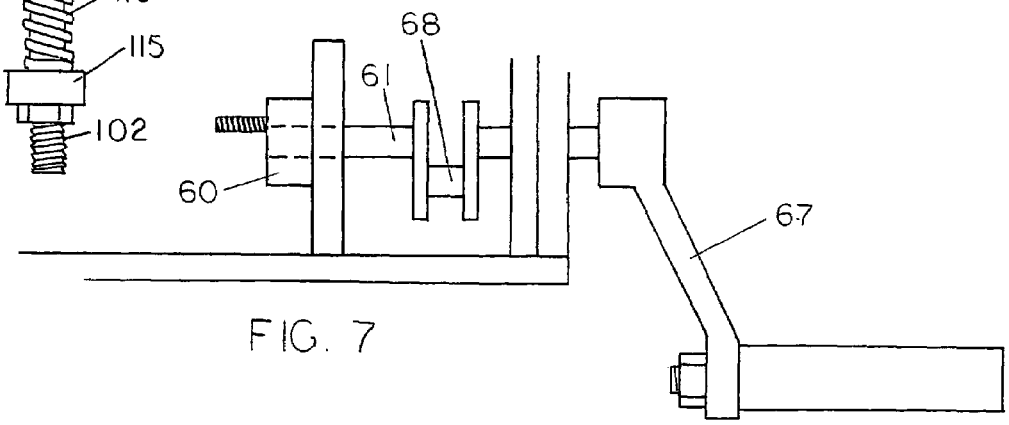
FIG. 7 is a top view of the off-set mechanism which operates both the roller cog driver and the knife.

In FIG. 4, the cog driver 92 is shown disengaged from the roller cog 53. In FIG. 5, the roller cog 53 is engaged by the cog driver 92 at the cog end 93 of the cog driver 92. The cog driver 92 also has a shaft end 94 which is connected to the offset shaft 68. The actuating shaft 61 includes the offset shaft 68 (FIG. 7) on which the cog driver 92 is rotatably mounted. When the actuating shaft 61 is rotated, the offset shaft 68 pushes and pulls the cog driver 92 backwards and forwards. When the cog driver 92 is disengaged from the roller cog 53, as shown in FIG. 4, the knife 65 is at the same time sweeping underneath the drive roller 47, as shown in FIG. 2. The guide 81 places an upsard pressure on the cog driver 92 to force the dog driver 92 upwardly to engage the next cog on the roller cog 53.

The offset shaft 61 on the actuating shaft 61 is located eccentrically to the actuating shaft 61. When the hand crank 67 is turned outside of the enclosure 21, the actuating shaft 61 is turned. The eccentric placement of the offset shaft 68 causes the cog driver 93 to move backward and forward in the guide 81 which causes the cog driver 93 to rotate the roller cog 53.

Referring now to FIG. 5, the cog driver 92 is shown engaged with the roller cog 53. When the actuating shaft 61 is turned, the cog driver 92 moves forward within the guide mount 83 and over the guide mount 83 to engage the roller cog 53 and ratchet it forward, thereby turning the drive roller shaft 51 and drive roller 45. At this point in the cycle, the knife 65 is withdrawn from under the tensioning roller 47 so that the knife 65 is visible, as shown in FIG. 3.

FIG. 6 Is a view looking down on the underside of the Cutting machine with the Cutting Machine upside down. A frame 95 is located across the inside of the rear wall 27 and the two side walls 31. The frame 95 provides structural strength for the Cutting Machine and support for the knife 65 as well as the tensioning shaft 39. The journal 62, as a result, is also supported by the frame 95 which in turn supports the tensioning roller 47. Across the rear wall 29, affixed to the frame 95, is a stationary blade 97 which interacts with the knife 65 to perform the cutting operation. The stationary blade 97 is secured to the lower surface 98 of the frame 95. The lower surface 98 faces away from the cover 33. An upper surface 99 of the frame 95 faces the cover 33. The knife pivot 69, previously discussed, includes an opening 95 in the knife 65 which permits rotational engagement of the blade 65 with the frame 95. A block 101, is held by bolt 102 on the knife 65 to provide control of the resistance to movement by the knife 65. The guide mount on the guide 81 is secured to the frame 95 along the side wall 31 and the actuating shaft 61 is mounted to rotate on the frame 95 along the side wall 31.

When the knife is drawn under the drive roller 45, the knife 65 moves in a cutting action against and underneath the stationary blade 97. This cuts the food product being fed into the input opening 35.

FIG. 6 shows the bolt 102, a knife tensioning spring 113, knife tensioning collar 115 and block 101 which holds the knife 65 against the stationary blade 97 to facilitate the cutting action. The stationary blade 97 (FIG. 6) is affixed at both ends to the bottom inside of the frame 95. The stationary blade 97 is immobile but has at least one sharp edge which is oriented to meet the cutting edge of the knife 65 as the knife 65 pivots against it.

While a preferred embodiment has been shown and described, it will be apparent tot hose skilled in the art that many other changes and modifications may be made without departing from the invention in its broader aspects. The appended claims are therefore intended to cover all such changes and modifications as fall withing the true spirit and scope of the invention.

What is claimed is:

1. A cutting machine for cutting food products, the cutting machine comprising:

an enclosure having an input opening;

a frame located within the enclosure;

a drive roller mounted to rotate within the enclosure;

a roller cog affixed to the drive roller;

a tensioning roller in the enclosure adjacent to and generally aligned with the drive roller;

a pair of tensioning shafts extending from outside the enclosure into the enclosure, the tensioning roller being mounted on the tensioning shafts;

an actuating shaft extending within the enclosure, the actuating shaft being rotatable and including an offset wheel and an offset shaft;

means for rotating the actuating shaft;

a stationary blade mounted on the frame generally beneath the drive roller;

a knife mounted to pivot on the frame so as to interact with the stationary blade;

an actuating rod mounted to pivot on the knife and on the offset wheel;

a cog driver connected to the offset shaft to engage the roller cog; and means for rotating the actuating shaft.

2. A Cutting Machine according to claim 1 wherein the roller cog is located on the same side of the enclosure as the actuating shaft.

3. A Cutting Machine to claim 1 wherein the actuating shaft is operated by a hand crank.

4. A Cutting Machine according to claim 1 wherein the pair of tensioning shafts move the tensioning roller toward and away from the drive roller.

5. A Cutting Machine according to claim 1 wherein the knife is mounted on a bolt and including a block on the bolt held against the knife by a spring.

6. A Cutting Machine according to claim 1 further including guide means for directing the cog driver.

7. A Cutting Machine according to claim 1 wherein the pair of tensioning shafts include journal blocks, the tensioning roller being mounted to rotate in the journal blocks.

8. A Cutting Machine according to claim 1 wherein the pair of tensioning shafts include journal blocks, the tensioning roller being mounted to rotate in the journal blocks, the tensioning shafts further including a collar mounted on each tensioning shaft and a spring mounted between the collar and the journal block.

9. A Cutting Machine according to claim 1 wherein the actuating shaft has an interior end, an offset wheel being mounted on the interior end of the actuating shaft.

10. A Cutting Machine for cutting food products, the cutting machine comprising:

an enclosure having a front wall, a rear wall and two side walls and a cover, the cover having an input opening through it;

a frame within the enclosure;

a drive roller mounted to rotate within the enclosure;

a roller cog affixed to drive roller;

a tensioning roller located within the enclosure adjacent to and generally aligned with the drive roller;

a pair of tensioning shafts extending through the front wall generally parallel to and adjacent the two side walls for mounting tensioning rollers, each tensioning shaft including means for moving the tensioning roller toward and away from the drive roller, the tensioning roller being mounted on the tensioning shafts;

an actuating shaft having an interior end and an exterior end and being rotatable, the actuating shaft including an offset wheel located on the interior end of the actuating shaft within the enclosure and an offset shaft located within the enclosure;

means outside the enclosure for rotating the actuating shaft;

a stationary blade mounted on the frame generally beneath the drive roller across the rear wall;

a knife bolt, an opening in a knife being mounted on the bolt for the knife to rotate;

adjustable means mounted on the knife bolt to press the knife against the stationary blade;

an actuating rod connected to pivot on the knife a short distance from the bolt and rotatably connected to the offset wheel;

a cog driver connected to the offset shaft to engage the roller cog; and a guide means for directing the cog driver.

11. A Cutting Machine to claim 9 wherein the actuating shaft is operated by a hand crank.

12. A Cutting Machine according to claim 10 wherein the pair of tensioning shafts include journal blocks, the tensioning roller being mounted to rotate in the journal blocks.

13. A Cutting Machine according to claim 10 wherein the pair of tensioning shafts include journal blocks, the tensioning roller being mounted to rotate in the journal blocks, the tensioning shafts further including a collar mounted on each tensioning shaft and a spring mounted between the collar and the journal block.

14. A Cutting Machine according to claim 10 wherein the adjustable means mounted on the knife bolt includes a block and a knife tensioning collar threaded onto the bolt and a spring between the block and the knife tensioning collar.

15. A Cutting Machine according to claim 10 wherein the frame has a lower surface which faces away from the cover, the stationary blade being mounted on the lower cover.

16. A Cutting Machine for cutting food products, the Catting Machine comprising:

an enclosure forming an interior within the enclosure and an exterior outside the enclosure, the enclosure having a front wall, a rear wall, the two side walls and a cover, the cover having an input opening through it and being mounted to rotate on the rear wall;

a frame located in the interior along the rear wall and the two side walls, the frame having an upper surface and a lower surface;

a drive roller including a drive roller body and a drive roller shaft, the drive roller shaft having two ends, the drive roller body being pronged, the drive roller being mounted to rotate in the frame;

a roller cog affixed to the drive roller shaft;

a tensioning roller mounted in the interior adjacent to and generally aligned with the drive roller, the tensioning roller body being compressible;

a pair of tensioning shafts extending through the front wall generally parallel to and adjacent to the two side walls, each tensioning shaft having an inner end in the interior near the rear wall and an exterior end outside the enclosure adjacent the front wall, journal blocks mounted on the tensioning shafts adjacent the inner ends, the tensioning roller shaft being mounted to rotate in the journal blocks, the tensioning shafts each further having a collar mounted on each tensioning shaft and a spring between the collar and the journal block, a knob being mounted on the exterior end of each tensioning shaft;

an actuating shaft having an interior and an exterior end mounted in the interior and extending to the interior through one of the side walls generally parallel to the drive roller and the tensioning roller, the actuating shaft including an offset wheel on the interior end of the actuating shaft in the interior of the enclosure and further including an offset shaft located between offset wheel and the side wall through which the actuating shaft extends;

means for rotating the actuating shaft mounted on the exterior end of the actuating shaft outside the enclosure;

a stationary blade mounted on the lower surface of the frame across the rear wall;

a knife having two ends and a knife body with a dull edge and a sharp edge and having a spring at one end;

a knife bolt affixed to the lower surface of the frame along the rear wall and located toward the side wall through which the actuating shaft extends, the knife being placed on the bolt through the opening in the knife, the sharp edge facing the rear wall;

a block mounted to slide on the knife bolt and to press against the knife;

a knife tensioning spring mounted on the knife bolt which presses against the block;

an actuating rod having two ends, one end being mounted to pivot on the knife a short distance from the bolt and the other end being connected to rotate on the offset wheel;

a guide mount secured to the frame along the side wall;

a guide mounted to rotate on the guide mount;

a spring connected to the guide and the guide mount; and a cog driver connected to the offset shaft and located in the guide mount to engage the roller cog.

* * * * *